United States Patent [19]

Naegeli et al.

[11] 4,025,302

[45] May 24, 1977

[54] METHOD OF PRODUCING A DYED AND STABILIZED NON-TWISTED FIBER SLIVER AND A FIBER SLIVER WITH MUTUALLY BONDED FIBERS

[75] Inventors: Werner Naegeli, Winterthur; Antonius Schneider, Basel, both of Switzerland

[73] Assignee: Pavena AG, Basel, Switzerland

[22] Filed: Sept. 3, 1974

[21] Appl. No.: 502,887

[30] Foreign Application Priority Data

Sept. 13, 1973 Switzerland ..... 13183/73
Apr. 22, 1974 Switzerland ..... 5149/74

[52] U.S. Cl. ..... 8/17; 8/18 R; 8/177 R

[51] Int. Cl.[2] ..... D06M 13/26; D06P 5/00; D06P 7/00

[58] Field of Search ..... 8/17, 18, 177 R

[56] References Cited

UNITED STATES PATENTS

| | | | |
|---|---|---|---|
| 3,093,867 | 6/1963 | Chandler | 8/17 |
| 3,617,204 | 11/1971 | Pirie | 8/17 |
| 3,787,176 | 1/1974 | Eltz et al. | 8/14 |

FOREIGN PATENTS OR APPLICATIONS

| | | | |
|---|---|---|---|
| 1,510,377 | 8/1970 | Germany | 8/177 R |
| 2,150,858 | 4/1972 | Germany | 8/177 R |
| 2,301,521 | 8/1973 | Germany | 8/18 |
| 1,322,914 | 7/1973 | United Kingdom | 8/177 R |

OTHER PUBLICATIONS

Chemical Abstracts, vol. 74, No. 24, June 14, 1971, p. 127,436e.

Chemical Abstracts, vol. 76, No. 4, Jan. 24, 1972, p. 15,706c.

*Primary Examiner*—Ronald W. Griffin
*Attorney, Agent, or Firm*—Werner W. Kleeman

[57] ABSTRACT

A method of producing a dyed and stabilized fiber sliver and sliver produced thereby wherein a non-twisted fiber arrangement is impregnated with a liquid for bonding the fibers, the liquid containing a dyestuff, and by application of pressure excessive or excess liquid is squeezed-off the fiber arrangement and the fibers are condensed or compacted at all sides into a compact sliver, and the individual fibers of the compact sliver at an increased or elevated temperature are mutually bonded and dyed, and the sliver is dryed. According to the invention the fiber arrangement is impregnated with a latent chemical compound activating the fiber material at the increased or elevated temperature, and the fibers after compacting into the compact sliver are dyed at the activating temperature and simultaneously are bonded mutually by the fiber material and the activating chemical compound is eliminated and the non-twisted sliver is dried.

40 Claims, No Drawings

METHOD OF PRODUCING A DYED AND STABILIZED NON-TWISTED FIBER SLIVER AND A FIBER SLIVER WITH MUTUALLY BONDED FIBERS

BACKGROUND OF THE INVENTION

The present invention relates to a new and improved method of producing a dyed and stabilized non-twisted fibre silver, and to a new and improved dyed and stabilized fibre sliver the fibres of which are mutually bonded produced according to such method.

From the specification of the German Pat. application No. 1,510,377 laid open to public inspection it is already known to produce in the spinning mill dyed and stabilized non-twisted fibre silvers, the individual fibres of which are dyed and mutually bonded. According to this method a through-passing non-twisted fibre arrangement is impregnated with a liquid containing a binding agent and a dye. Subsequently, excessive liquid is squeezed off under application of pressure and the fibres are compressed or condensed at all sides into a compact sliver. After the binding agent is bonded under application of heat, i.e. under increased or elevated temperatue, and after drying the compact silver, there is obtained the dyed and stabilized fibre sliver in which the fibres are mutually bonded by the binding agent. Even if the application of the binding agent and of the dye is effected in one and the same processing step, compatibility of the simultaneously applied binding agent and dye is required in a manner such that e.g. the bonding of the fibres is not influenced by the dye. This can be disadvantageous in certain cases.

A further disadvantage of this method is seen in that certain dyes and binding agents cannot be distributed, e.g. solved, sufficiently in one and the same liquid, and thus cannot be applied according to the proposed prior art method. This disadvantage makes itself felt e.g. if synthetic fibre materials are processed. Due to e.g. different affinities of a dye to various binding agents, in many cases application of a greater dye quantity is required than needed for dyeing the fibres in the sliver to a desired colour. Thus the simultaneous dyeing and bonding process not only becomes complicated but also economically unfavourable. It also has been found that the stabilized sliver produced by application of a binding agent can cause in the subsequent processes, e.g. in a subsequent drafting process and in a possible subsequent twist-imparting process to produce a yarn, or in directly weaving it, increased dust accumulation in the drafting a system or on the ring spinning frame, respectively, or on the loom, which is generated as the dryed binding agent is shed off while the bonds are broken during the drafting process or by friction respectively. Frequent cleaning of these devices thus is required if disturbances are to be avoided, which reduces the economic feasibility of the use of stabilized fibre slivers. Reduction of the binding agent quantity does not result in reduced dust or fly shedding, but reduces the stability or the strength respectively, of the fibre sliver in such manner that it no longer has the characteristics desired for further processing. Another disadvantage is seen in that in many cases an end product made from the stabilized fibre sliver must be washed for elininating the binding agent which can influence in an undesirable manner the characteristics or properties of the end product, e.g. its hand.

From the publication or literature, as cited in "Chemiefasern/Textilindustrie," No. 8, 1973, pages 752 through 754, the production of non-woven end products is known, in which a latent solvent of a fibre material, i.e. a solvent not acting upon the fibre material at room temperature is sprayed or dripped either before carding onto the fibre material in a hopper feeder or a web thereof or after carding onto a fibre web. Subsequently the fibre assembly treated with the latent solvent is heated to a temperature at which the fibres are activated by the solvent, in which process the fibres are partially solved by the solvent and are mutually welded at their contact points and the latent solvent is evaporated. Also this so-called "solvent bonding" process permits bonding of fibres protruding from the fibre assembly in woven, knitted, tufted or non-woven products, i.e. also in end products also, in such a manner that the quantity of protruding fibres is reduced. For activating the latent solvent, hot air is guided through the web in such a manner that the web is supported by the air. The textile end products produced according to the solvent bonding process are of a structure which, owing to the solvent bonding, consists only of the bonded fibre material.

Spraying or dipping the latent solvent, however, does not permit sufficient wetting of a fibre assembly as considered over its whole thickness, and thus subsequently no uniform bonding action over the thickness of the fibre assembly can be effected. The fibre mass present in a hopper feeder, known to be large and to be randomly arranged, or the web or fabric of large dimensions thus can be wetted only on their surface or in a zone near the surface. In particular, in a woven fabric made from twisted yarns, no uniform wetting can be effected across the yarn as this process in hampered or precluded by the fibres closely arranged side by side due to the twist. For this reason also, using a dye solved in the latent solvent, it is not possible to achieve any satisfactory and uniform dyeing of such fibre assemblies as the fibre assembly also cannot be sufficiently wetted with the dye. In the known method, activating temperatures ranging from 60° to 200° C are proposed, the coloration or dyeing, however, is not fast or durable. If a quantity of solvent, and thus also of dye, is applied, sufficient for obtaining sufficient wetting across the whole thickness, uniform wetting still cannot be achieved as, for the reasons mentioned above, the zones near the surface are wetted more intensively than the inside zones of the fibre assembly. Also, guiding hot air through the fibre assembly can be effected only with a fibre assembly in which the fibres or fibre aggregations are randomly oriented, such as e.g. in a web, or which has sufficient cohesion owing to twist or due to its woven construction. The known method thus is suitable merely for solvent bonding of more or less large fibre aggregations or twisted or woven yarns, which are bonded mutually, and is not applicable for a durable coloration completely throughout the fabric nor for mutually bonding the individual fibres of such fibre assemblies nor for a non-twisted According arrangement. According to the British Pat. Specification No. 1,098,106 or the German Pat. application No. 1,958,472 laid open to public inspection, it is also known to dye yarns wound into a package, e.g. made from polyacrylonitrile fibres, in an aqueous solution of a basic or cationic dyestuff containing a chemical compound, e.g. tetramethylenesulfone, which in an aqueous solution partially solves or swells the fibres and thus makes possible a dyeing process at temperatures of 80° C at the highest. Before the yarns, in the method according to German Pat. application No. 1,958,472, wound into the package and treated with the dyestuff solution, are brought to a temperature of up to 100° C subsequently, the partially solving chemical compound is washed out first and at the temperature mentioned no longer can act on the fibre material.

OBJECTS OF THE INVENTION

It is an object of the present invention, to eliminate the disadvantages of the methods known thus far of producing a dyed and stabilized non-twisted fibre sliver, and to provide a method by which a non-twisted fibre sliver or strand in a simplified and ecomonically feasible manner can be dyed and by which the individual fibres can be bonded mutually, the dyeing of the individual fibres and their mutual bonding being effected without mutual disturbances.

It is a further object of the present invention to produce a stabilized non-twisted fibre sliver or strand with a desired dyeing and mutual bonding of the individual fibres, which is free of components impairing further processing of the fibre sliver or detrimentally affecting the characteristics of an end product made from the fibre sliver. Based on the knowledge that according to the methods known thus far neither mutual bonding of individual fibres free of bonding agents or an adhesive, non dyeing of the individual fibre could be achieved in a desired manner, it is a further object of the present invention to achieve this.

DETAILED DESCRIPTION OF THE INVENTION

The method of producing a dyed and stabilized fibre sliver is based on an impregnation of a non-twisted fibre arrangement with a liquid for binding the fibres which contains a dyestuff. Excessive liquid is squeezed-off the fibre arrangement by application of pressure and the fibres are condensed or compacted at all sides into a compact sliver. The fibres of the compact sliver are mutually bonded and dyed at an increased or elevated temperature, and the sliver is dried. The method according to the invention is characterized in that the arrangement of fibres is impregnated with a latent chemical compound which activates the fibre material as the temperature is increased. According to the invention the fibres after condensing or compacting into the compact sliver are dyed at the activating temperature and simultaneously are mutually bonded by the fibre material and the activating chemical compound is eliminated and the non-twisted sliver is dried.

The dyed and stabilized non-twisted fibre sliver produced according to the inventive method contains individual fibres which are dyed and are mutually bonded by the fibre material.

In combination with the advantage, that the activating chemical compound and thus also the dyestuff can penetrate uniformly across the whole cross-section, or the whole thickness, respectively, of the fibre arrangement, in this manner the chemical compound or substance and the dyestuff simultaneously can reach the individual fibres inside the fibre arrangement and a "skin" of the chemical compound and of the dyestuff can be formed surrounding each individual fibre. Binding of the fibres can not be impaired by the dyestuff or, vice-versa, dyeing can not be impaired by the activating chemical compound, as the surface of the fibres and therefore the fibre material can be activated in the same manner for dyeing as well as for binding, and the affinity or the binding forces between the dyestuff and the fibre material of the individual fibre, as well as between the individual fibres can be favoured and increased. Thus simultaneously the dyestuff can be more advantageously taken up in a desired manner by the individual fibres and the individual fibres can form bonds at their mutual contacting points. In particular, the activating chemical compound can loosen or partially swell and/or solve the fibre structure in such manner that bonding of the dyestuff to the activated individual fibre can be effected, the binding force being determined by the bonds between the dyestuff and the fibre material. As the dyestuff can be bonded directly to the fibre material which is activated, a substantially better fixation and thus a higher degree of fixation of the dyestuff on the fibre can be effected, as compared to dyeing methods known thus far, in such manner that washing out of non-fixed dyestuff can be dispensed with and that thus a more efficient operation can be effected. At the same time mutual bonding of the fibres can be achieved, the binding forces being determined by the bonds of the fibre material at the mutual contacting points of the fibres.

While the fibres are condensed or compacted from all sides into the compact sliver, e.g. the number of contacting points between the individual fibres is increased in advantageous manner, so that the bonding of the fibres in the sliver does not depend upon the presence of contacting points possibly present in the sliver. Thus e.g. uniform bonding of the individual fibres over the sliver cross-section is achieved which results in an increased stability or strength of the sliver after drying. Furthermore, by compacting into the compact sliver the sliver structure achieved in the wet or moist state is maintained during the subsequent binding process and the fibres are actually bound mutually in this compacted form. Compacting from or at all sides also prevents opening of the compact sliver while the liquid is evaporated during the drying process or during the transport to the next processing step. Thus a stabilized fibre sliver can be produced, the cross-section of which is desirable for specific further processing steps of the stabilized fibre sliver.

Using the inventive method, draftable stabilized fibre slivers can be produced, i.e. fibre slivers which on a drafting system can be drafted without destruction of the fibres, the bonds between the fibres being broken or ruptured in the process and, if desired, subsequently can be spun into a twisted yarn, twist being imparted. The dyestuff thus can be introduced or brought in, using the inventive method, e.g. in a step of the spinning process sequence in which the dyestuff still can reach the individual fibres of the fibre arrangement to be spun. This has the advantage that the colour fastness of a yarn which can be produced from a stabilized sliver, is better as each fibre is dyed before it is spun into a yarn. Also, however, stabilized fibre slivers can be produced, the stability or strength, respectively, of which is such that they can be processed directly and without imparting twist into a textile product, e.g. into a fabric. Owing to the application of the dyestuff using the inventive method, end products produced directly from dyed and stabilized fibre slivers also can possess better colour fastness. As the bonds between the fibres are maintained in the end products, such end products furthermore show improved strength, abrasion resistance and thus higher wear resistance. As the fibres can be mutually bonded directly and as the activating chemical compound is removed from the fibre arrangement a stabilized fibre sliver can be produced which is free of binders or adhesives and which e.g. does not exhibit any disturbances relative to a binding agent in the further processing sequence to form an end product. In particular, the end product made from the stabilized fibre sliver, e.g. a yarn or a fabric, can be used without being washed previously.

The fibres of the fibre arrangement to a certain degree can be arranged in a parallelized state or parallely oriented, i.e. with few fibre cross over points being present. This can be achieved in an advantageous manner by drafting the fibre arrangement which can be a card sliver or a draw-frame sliver, doubled if desired, immediately before it is impregnated. By drafting prior to the impregnation or imbuing can be created these conditions after the binding of the fibres in this parallelized state which are desirable for a subsequent draft.

By using the inventive method, the stabilized fibre sliver can be stabilized in its lengthwise or longitudinal direction as well as across its cross-section, i.e. in its transverse direction. These properties can be of importance for further processing of the fibre sliver and for its application and use in an end product. Thus, the strength properties of an end product made from the stabilized fibre sliver can be improved substantially. By stabilizing the fibre sliver lengthwise and across its cross-section also a subsequent drafting process is improved. The importance of the lengthwise stabilization and the transverse stabilization, i.e. across the cross-section, in drafting a stabilized fibre sliver consisting of bonded fibres is known from Swiss Patent Specification No. 526,649 which is referred to in this context and the disclosure of which is incorporated herein by reference. The activating compound, which preferably at room temperature is still latent, i.e. does not influence or act upon the fibre material, can be a liquid and can be applied undiluted, it also can, however, be applied distributed as a liquid or solid chemical or substance in a liquid, e.g. dispersed or solved, i.e. diluted. The degree of concentration at which the chemical can be applied depends on, among other factors, the aggressiveness with which the chemical activates the fibres. Too aggressive or strong activation can detrimentally influence the individual fibres, possibly to a state of dissolution of the fibres by the activating chemical. If the fibres e.g. are activated at room temperature already by an undiluted liquid chemical, the chemical is applied e.g. in diluted form in such a manner that the activation can be effected only at a temperature greater than the room temperature. For one and the same fibre material by suitably choosing the concentration of one and the same activating chemical in a dye bath liquid, the aggressiveness or strength of the activation at the activation temperature, and thus a desired strength of the mutual bonding of the individual fibres as well as the strength, i.e. the stabilization of the fibre sliver can be achieved. In an advantageous implementation of the invention by suitably choosing the activating chemical and its concentration there can be thus, produced draftable or non-draftable stabilized fibre slivers. As a distributing or diluting agent an inorganic liquid, e.g. water can be used, or an organic liquid can be used, depending upon the desired distribution of the activating chemical and/or of the dyestuff in the liquid. Water presents the advantage that a cheap liquid can be used as a dye bath liquid, which compared to an organic liquid used as a diluent, can be handled in a simple and safe manner when preparing the dye bath liquid, during impregnating the fibre sliver therewith and/or during drying. If a chemical is used which cannot be easily distributed in water, e.g. which is water-insoluble, an emulsifier, preferably a non-ionogenic emulsifier, can be added, which can be an alcohol, such as methyl alcohol or ethyl alcohol.

Advantageously, a dye bath liquid or liquor can be used for impregnating in which there is dissolved both the activating chemical and the dyestuff. In such manner the activating chemical as well as the dyestuff can be applied to the fibres in uniform concentration.

In an advantageous embodiment of the invention the activating chemical and, if desired, also the diluent, can possess vapour pressures at the activation temperature which are such that evaporation can take place at the activation temperature, in which case the sliver at the same time can be also dried. In binding and dyeing the fibres under evaporation of the chemical the fibres preferably are activated only for the duration, i.e. for the period of time of the evaporation, i.e. temporarily, in such a manner that the activation is terminated as soon as the activating chemical is evaporated, preferably substantially in its totality, and there can be avoided an undesired prevailing of the activation. Also, activating chemicals can be applied which are evaporated before the diluent evaporates, the sliver subsequently being dried by a further heat treatment by further raising the temperature after the activating treatment.

In another embodiment of the invention method the activating chemical and the diluent or the chemical only can have vapour pressures at the activating temperature, causing the chemical and the diluent to remain in the sliver at the activating temperature, i.e. that they cannot evaporate. The sliver then can be exposed for a certain duration to the activating temperature and subsequently can be cooled or subjected to a temperature at which the chemical again is latent with respect to the fibre material and the activating chemical can be washed out. Subsequently, the dye stabilized fibre sliver can be dried, the washing liquid and any diluent still present being evaporated.

In a still further embodiment of the invention a thickener, e.g. locust bean flour preparations, carboxymethyl-cellulose, starch ethers or the like, can be added to the dye bath liquid or liquor together with the activating chemical in such a manner that the viscosity of the dye bath liquid is increased, and thus, migration of the dye bath liquid in the fibre arrangement can be reduced. In this manner migration of the dye bath liquid into the outer zones or regions of the sliver can be reduced, if not prevented. The increase in viscosity, however, also can reduce the activation of the fibres and thus the strength of the fibre bonding. The use of a thickener thus can influence the inventive method in the direction of a production of a draftable sliver. For producing a draftable sliver e.g. a viscosity of at least 60 centipoise is preferred. To the dye bath liquid further agents can be added for additional treatment of the fibres, e.g. textile finishing agents, such as fungicides, resin finishes or similar agents, as such agents are applied or brought to the fibres in the same manner using the inventive method and can be taken up by the fibres at the activating temperature in such a manner that the individual fibres can contain such agents in the stabilized fibre sliver.

In a further embodiment of the inventive method fixation of the dyestuff on the fibres is effected at a suitable temperature. This can be effected in an advantageous manner at the activating temperature in such a manner that an additional heat treatment can be avoided. The fixation, however, also can be effected after the elimination of the activating chemical, if e.g. the activating temperature is not high enough for reaching a sufficient degree of dyestuff fixation.

The activating temperature level depends in each case on the activating chemical applied and/or on the fibre material processed. The activating temperature level can be chosen at least as high as to permit evaporation of the activating chemical and/or possibly the diluent as well as the fixation of the dyestuff at this temperature level. For activating the fibres, fixation of the dyestuff and for drying the sliver there can be provided a dry or a humid heat treatment. Overheated or superheated steam at a temperature above 100° C and at absolute steam contents ranging from 70 to 100 percent and at a pressure of 1 atmosphere, or saturated steam at 100° C or at more than 100° C under above-atmospheric pressure can be applied. Depending upon the temperature, the steam concentration and the pressure applied, the duration of the heat treatment can range from 30 seconds to 30 minutes.

Notwithstanding the fact that fixation can be effected already at activating temperatures ranging from 120° to 130° C, temperatures of less than 160° C can, depending on the fibre material processed, result in unsatisfactory degrees of fixation, and thus fixation temperatures ranging from 160° to 180° C are preferred. In order to prevent fibre damage, e.g. the danger of fusing fibres made of synthetic fibre material, e.g. an activating temperature not exceeding 180° C and possibly a short duration of exposure to the activating temperature are applied.

If certain synthetic fibres, e.g. made from polyester or natural fibres are processed, however, also temperatures in excess of 180° C, possibly also over short durations of exposure, can be applied for activating or drying. In an advantageous extended embodiment of the inventive method the compact sliver can be subjected to the activating temperature during a time ranging from 30 to 90 seconds only while the material is passing through at speeds e.g. ranging from 100 to 200 meters per minute.

Latent chemical agents, also called "latent solvents" for activating fibres made from synthetic material such as polyacrylonitrile, polyamides, polyesters or polyolefines, or for activating natural fibres such as natural silk, tanninmordant cotton, partly are known as such already from the literature and can be determined by one skilled in the art by experiments for the fibre material to be processed. Thus e.g. for fibres made from polyacrylonitrile, agents such as the following can be used as activating chemicals: alkylene carbonates such as ethylene carbonate, propylene carbonate, trimethylene carbonate, tetramethylene carbonate, 2, 3-butylene carbonate or glycerine carbonate, or other, in particular cyclic diesters or carbonic acid with glycols, or furthermore compounds with at least one cyanic-group in the molecule, aliphatic, cyclo-aliphatic or aromatic, possibly substituted, mononitriles or dinitriles, such as e.g. benzylpropoxynitrile, or 2-phenoxyethanol or mono-chlorphenoxyethanol or tetramethylene sulfone, in particular cyclic tetramethylene sulfone or mixtures thereof. Tetramethylene sulfone also can be used as activating chemical for fibres made from cellulose diacetate or cellulose triacetate, chloro fibres, natural silk or tanninmordant cotton.

The chemical agents mentioned above are already known as auxiliary chemicals in dyeing and have been applied in a dye bath liquid at temperatures, among other applications of up to 100° C in a manner known as such for dyeing fabrics, twisted yarns or endless filaments. In such known applications, however, the dry bath liquid with the activating chemical is washed out, i.e. removed from the fibre arrangement before drying thereof in such manner that no mutual binding of fibres can occur as the liquid is evaporated, since the intention of conventional dyeing methods never has been mutual bonding of fibres. According to the literature cited above, in the periodical "Chemiefasern/Textil-industrie, 73, No. 8, pp 752 through 754" e.g. tetramethylene sulfones also were applied already as latent solvents in the production of non-woven products, in which process, however, mutual bonding of individual fibres in the fibre arrangement can not occur as described above. However, according to the present invention the individual fibres are bonded or connected to each other and dyed by the activating chemical compound in the fibre arrangement in such a manner that the problem of producing a stabilized fibre sliver with a desired dyeing and binding of the individual fibre is solved in an advantageous manner.

The addition of benzylpropoxynitrile, tetramethylene-sulfone, ethylene carbonate, propylene carbonate, 2-phenoxyethanol or monochlorophenoxyethanol, or mixtures thereof, such as, in particular, mixtures of 2-phenoxyethanol and tetramethylene-sulfone or monochlorphenoxyethanol and tetramethylenesulfone, preferably in the mixture ratio of 1:3 in each case, can be made in the dispersed or dissolved form. These compounds can effect, on the one hand, a fixing acceleration of the dyestuff being used, with a shortening of the fixing time to the extent of about half being obtained, compared with that in the case of the conventional process without the addition of these specific compounds, and possess, on the other hand, a bonding action with regard to the material. The preferred compound is tetramethylenesulfone.

The selection of the activating chemical can depend on how aggressively or strongly it can activate, e.g. can solve, the fibre material to be processed, and what degree of strength, i.e. stabilization of the fibre sliver is to be achieved by bonding the fibres in the sliver, i.e. what degree of strength of the bonding is desired. If the activating chemical at the activating temperature can not evaporate, this activating chemical can prove advantageous if it attacks or solves at a desired concentration e.g. the fibres less than another activating chemical. Then a fibre bonding action can be effected which permits a subsequent drafting of the stabilized fibre sliver on a drafting arrangement.

According to the inventive method staple fibres or endless threads also called endless filaments, which consist e.g. of filament groups or bundles, can be dyed and mutually bonded in the sliver.

As dyestuff, basical, i.e. cationic or acid, i.e. anionic dyestuffs or also dispersion dyestuff can be applied. The type of dyestuff to be used is selected e.g. with respect to the activating chemical which can be used in the dye bath liquid and with respect to the fibre material to be processed. Thus cationic or anionic dyestuffs with alkylene carbonates as an activating chemical can be applied for dyeing fibres made from polyacrylonitriles. Cationic dyestuffs also with tetramethylenesulfones as activating chemical can be applied for dyeing fibres made from polyacrylnitriles, natural silk of from tanninmordant cotton. Cationic dyestuffs preferentially are applied in an aqueous acid bath or liquor the pH-value of which can be adjusted to about 3 to 6, particularly 4 to 5, by means of acids e.g. organic acids, such as formic acid, tartaric or citric acid being added. Optical brighteners, in the sense of the invention, also can be considered as dyestuffs. The quantities or the amount in which the dyestuff or optical brighteners can be applied, depends e.g. upon the type of dyestuff of the optical brightener, respectively, and/or upon the depth or intensity of the colouration or of the optical brightening desired. Cationic dyestuffs can be applied in quantities of 0.01 to 10 percent of the weight and cationic brighteners can be applied in quantities of 0.01 to 1 percent of the weight.

The cationic dyestuffs and optical brighteners used can be the usual salts or metal halide double salts, e.g. zinc chloride double salts, or the known cationic dyestuffs and optical brighteners. The cationic dyestuffs concerned are chromophoric systems of which the cationic character is due to a carbonium, ammonium, oxonium or sulphonium grouping, and which advantageously are in the form of water-soluble salts. Examples of such chromophoric systems are methine, azamethine, hydrazone, azine, oxazine, thiazine, xanthene, acridine, polyarylmethane and coumarin dyestuffs; also dye salts of the arylazo, phthalocyanine and anthraquinone series having an external ammonium group.

The cationic optical brighteners concerned are water-soluble salts of cationic optical brighteners from the methine, azamethine, benzimidazole, coumarin, naphthalimide or pyrazoline series. To be mentioned as materials dyeable with cationic dyestuffs can be: acid modified polyamides, such as poly-condensation products from 4,4'-diamino-2,2'-diphenyl-disulphonic acid or 4,4'-diamino-2,2'-diphenylalkane-disulphonic acids with polyamide-forming starting materials, polycondensation products from monoaminocarboxylic acids or their amide-forming derivatives or dibasic carboxylic acids and diamines with aromatic dicarboxysulphonic acids, e.g. polycondensation products from ε-caprolactam or hexamethylene diammonium adipate with potassium-3,5-dicarboxybenzenesulfonate, or acid modified polyester fibres, such as polycondensation products from aromatic polycarboxylic acids, e.g. terephthalic acid or isophthalic acid, polyvalent alcohols, e.g. ethylene glycol, and 1,2- or 1,3-dihydroxy-3-(3-sodium sulfopropoxy)-propane, 2,3-dihydroxy-1(3-sodium sulfopropoxy)-butane, 2,3-bis-(3-sodium sulphopropoxyphenyl)-propane or 3,5-dicarboxybenzenesulfonic acid or sulfonated terephthalic acid, sulfonated 4-methoxybenzenecarboxylic acid or sulfonated dyphenyl-4,4'-dicarboxylic acid. Preferred materials can be, however, fibre material made from polyacrylonitrile or from polyacrylonitrile copolymers. In the case of polyacrylonitrile copolymers, the acrylic proportion can be higher than 85 percent by weight of the copolymer. There can be used as comonomers, besides acrylonitrile, normally other vinyl compounds, such as e.g. vinylidene chloride, vinylidene cyanide, vinyl chloride, methacrylates, methylvinylpyridine, N-vinylpyrrolidone, vinyl acetate, vinyl alcohol or styrene sulfonic acids. Also suitable can be modacrylic fibres, i.e. polyacrylonitrile polymers wherein the acrylic part is less than 85 percent by weight.

The inventive method can be carried out in such manner that the non-twisted fibre sliver, in which the fibres, e.g. staple fibres are arranged in parallel state or in a substantially parallel state, is supplied to a device in which the impregnation and condensing or compacting at all sides into a compact sliver can be effected. A device suitable for this process contains a pair of rotating discs, the peripheries, i.e. envelope or jacket surfaces, of which are arranged mutually opposed in such a manner that the fibre sliver or strand can pass between them. At the face sides of the discs, the dye bath liquid is brought in and between lateral cover plates and the disc face sides form a supporting liquid film for the disc and reaches a space or room, seen in the direction of the fibre sliver throughput, in front of the discs, which room or space is formed by the disc envelope surfaces and also by the lateral cover plates. In this space or room a liquor envelope surrounding the fibre sliver can be formed which is pressed into the fibre sliver by the discs, the envelope surfaces of which are pressed against each other, in which process also excessive liquor, i.e. dye bath liquid, is squeezed off the fibre arrangement. At the same time the fibres of the fibre arrangement are condensed or compacted at all sides into the compact sliver which is delivered continuously. A device of this type is described in German Patent Applications No. 2,150,858 or No. 2,301,521 respectively, laid open to public inspection, which publications are referred to here and the disclosures of which are incorporated herein by reference. The compact non-twisted sliver can be subjected immediately thereafter in any suitable device to an increase in temperature for activating the fibre material by the activating chemical, and in the process can be dried simultaneously or subsequently. For this process the compact and still humid sliver continuously passes through e.g. a treatment room, in which a heat treatment under increased or elevated temperature of the sliver can be effected. Devices of this type, suitable for the heat treatment for activating the fibres and also for evaporating the activating chemical and possibly of the diluent, are described in the German Patent Applications Nos. 2,163,959 and 2,229,890 respectively, laid open to public inspection which publications thus are referred to here and the disclosures of which are incorporated herein by reference.

The invention is described in greater detail hereinafter with reference to Examples which, however, do not limit the scope of the invention in any way.

In the following Examples 1 through 5 three slivers of polyacrylonitrile fibres of the Dralon type, as marketed by Farbenfabriken Bayer AG, Leverkusen, German Federal Republic, of 60 millimeters staple length, and of a fibre fineness of 3 den each of a sliver weight corresponding to an English cotton count 0.12 or 4900 tex, were doubled as a sliver input of a weight corresponding to an English cotton count 0.04 or 14700 tex, and in a drafting arrangement were drafted at a drafting ratio of 7.5 to a fibre arrangement of an English cotton count 0.3 or 1900 tex. This fibre arrangement then was brought into an impregnating device such as described in the already mentioned German Pat. application No. 2,301,521 and immediately subsequently was subject to a heat treatment in a device such as described in the German Patent Applications Nos. 2,165,959 and 2,229,890 also already mentioned above.

EXAMPLE 1

For comparison purposes first a stabilized fibre sliver was produced, the individual fibres of which were bound in the sliver using an adhesive.

Impregnation of the comparison sliver was effected using an aqueous dye bath liquid containing in one liter of water:

25 g of the cationic dyestuff of the formula:

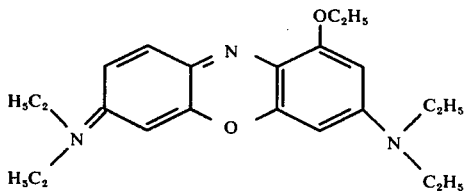

40 g ethyl alcohol 95 per cent 60 g of the polyvinylalcohol Elvanol of the type 51-05, marketed by Du Pont de Nemours International S.A. Geneva, Switzerland and E. I. Du Pont de Nemours % Co. Inc., Wilmington, Del., USA, as an adhesive.

The pH-value of the dye bath liquor was adjusted to pH4 by adding tartaric acid. The ethyl alcohol was added for wetting the dyestuff before bringing it into the aqueous bath, which did not influence the fixation of the dyestuff nor was it used for binding the fibres. By application of a specific surface compression or pressure of 200 kg per square centimeter which acts at all sides of the fibre arrangement, the liquid was squeezed off the fibre arrangement to a residual or remaining liquor content of 45 percent and the fibres of the fibre arrangement were condensed or compacted into a compact sliver.

The compact and still moist sliver subsequently was heated in a humid atmosphere of superheated steam the absolute steam content of which was 90 percent, at a pressure of 1 atmosphere, to a temperature of 106° C, at which temperature the sliver was dried and the fibres were mutually bound by the adhesive and fixation of the dyestuff on the fibres was effected.

The degree of fixation of the dyestuff on the fibres after washing out of the sliver was 25 percent. The breaking length of the resulting blue sliver was found to be about 4900 meters. The sliver with this breaking length was not draftable on a drafting arrangement.

EXAMPLE 2

A further fibre arrangement was impregnated with an aqueous-acid liquor, i.e. dye bath liquid, containing in one liter of water:

100 g of a cationic dyestuff mixture consisting of 1.8 parts of the dyestuff of the formula:

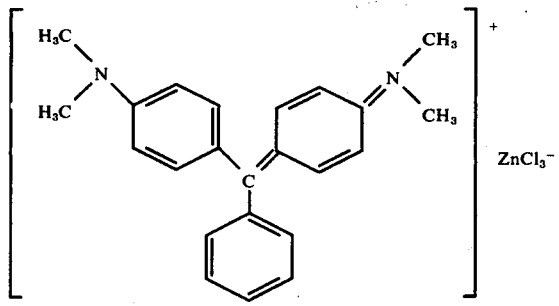

1.3 parts of the dyestuff of the formula:

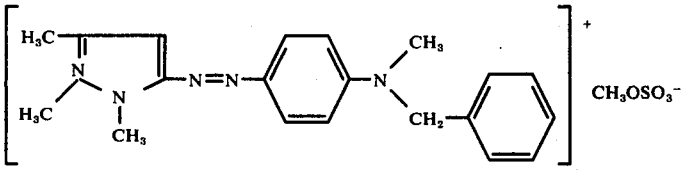

1.05 parts of the dyestuff of the formula:

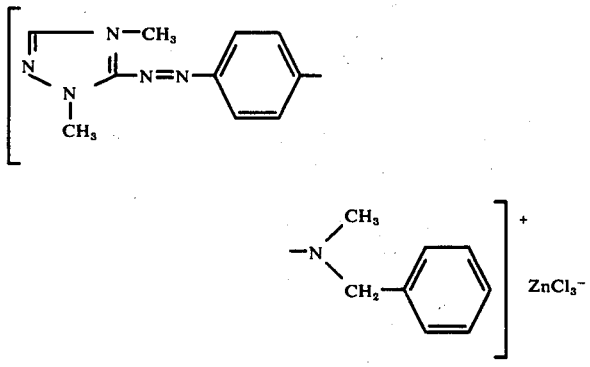

and 0.25 parts of the dyestuff of the formula:

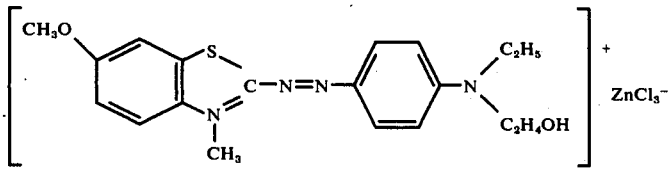

60 g ethylene carbonate, marketed by Fluka AG, Buchs, Switzerland, as latent activating chemical compound.

60 g Meyprogum a locust bean flour preparation marketed by the Meyhall Chemical AG, Kreuzlingen, Switzerland, as a thickener, and 75 g ethyl alcohol of 95 percent as a wetting agent for the dyestuff.

The pH-value was adjusted to pH4 by addition of tartaric acid.

The liquor was squeezed off the fibre arrangement by application of a specific surface compression on the order of approximately 200 kg per square centimeter to a remaining liquor content of 55 percent in the fibre arrangement which was compacted at all sides and formed into a compact sliver. Subsequently the moist sliver was heated with superheated steam of 90 percent, at a pressure of one atmosphere to a temperature of 106° C, at which temperature the fibres were activated, dyed and at the same time were bonded and connected to another, respectively, while at the same time the ethylene carbonate and the water were evaporated and the sliver thus was dryed.

The fixation of the dyestuff on the fibre was effected simultaneously with the activation. The degree of dyestuff fixation was found to be 97 percent. The breaking lenght of the black stabilized fibre sliver was of the order of 2500 meters. The fibre sliver of this breaking length was draftable on a drafting arrangement, considerable dust shedding, however, was noted during further processing.

EXAMPLE 3

A further fibre sliver was impregnated using a dye bath liquid containing in one liter of water:

100 g of the dyestuff mixture as specified in Example 2, 60 g ehtylene carbonate as specified in Example 2, as an activating chemical, 9 g Meypro-Gum PAT/S, also a locust bean flour preparation marketed by the Meyhall Chemical AG, mentioned in Example 2 as a thickner and 75 g ehtyl alcohol of 95 percent as a wetting agent for the dyestuff.

The pH-value again was adjusted to pH4. As described for Example 2 the fibre arrangement was squeezed to a remaining liquor content of 52 percent in the fibre arrangement and was compacted and also according to Example 2 was dryed and dyestuff fixation was effected. The degree of dyestuff fixation was found to be 97 percent. The breaking length of the black stabilized fibre sliver was found to be approximately 4100 meters. The stabilized fibre sliver with this breaking length was nondraftable on a drafting arrangement owing to the stronger bonding of the fibres.

EXAMPLE 4

A further fibre arrangement was impregnated using a dye bath liquor containing in one liter of water:

25 g of the dyestuff as specified in Example 1, 60 g Bondolane, marketed by the Shell Chemical, supplied by the Shell (Switzerland) Co. Zurich, Switzerland, which contains a tetramethylene sulfone as an activating chemical compound, 60 g Meyprogum NP 25 as specified in Example 2, and 38 g ehtylene alcohol of .95 percent as a wetting agent for the dyestuff.

By addition of tartaric acid the dye bath liquor again was adjusted the pH4.

After squeezing off to a liquid content of 50 percent in the fibre arrangement compacting, activation and drying as described in Example 2 a stabilized fibre sliver was obtained, the degree of dyestuff fixation in which was found to be 98 percent, the breaking length being approximately 3600 meters. The blue stabilized fibre sliver with this breaking length was draftable, considerable dust shedding, however, was noted during further processing.

EXAMPLE 5

A further fibre arrangement was impregnated using a dye bath liquor containing in one liter of water:

25 g of the dyestuff specified in Example 1,

60 G Bondolane as specified in Example 4, as activating chemical, 9 g Meypro-Gum PAT/S as specified in Example 2, as thickener, and 39 g ethyl alcohol of 95 percent as wetting agent for the dyestuff.

The dye bath liquor was adjusted to pH4 by adding tartaric acid. After squeezing to a liquor content of 45 percent remaining in the arrangement and after compacting, activation and drying as described in Example 2, a stabilized fibre sliver was obtained in which the degree of dyestuff fixation was found to be 98 percent and the breaking length of which was found to be approximately 8800 meters.

The blue sliver with this breaking length was not draftable on a drafting arrangement.

The Examples 2 through 5 demonstrate that the thickeners added do not exert any binding or adhesive function. The comparison of Example 2 and Example 3 and of Example 4 and Example 5, respectively, show, that the breaking length of the fibre sliver is about doubled. The quantity of thickness added being reduced. The slivers obtained in Examples 3 and 5 were not draftable at the resulting breaking lengths of the respective slivers, while the slivers obtained in Examples 2 and 4 at the resulting breaking lengths of the respective fibre slivers were found to be draftable. The draftability thus can be considered as resulting from the increased quantity of thickener added, as the content of activating chemical was the same in Examples 2 and 3, or in Examples 4 and 5 respectively. A sort of "buffer action" influencing the activating chemical, and thus the activation itself, thus can be attributed to the thickener, which action can be explained by the reduced migration of the dye bath liquor owing to the increase in viscosity of the liquor caused by the thickener. The Examples 2 through 5 show that the activating compound can be made responsible for bonding or connecting of the fibers, in contrast to Example 1 according to which the fibers were connected to another by an adhesive. The Examples 2 through 5 further show that in comparison with Example 1 e.g. the degree of dyestuff fixation can be considerable higher, about fourfold higher, than in the sliver in which the binding was effected with the adhesive according to Example 1, which fixation can be attributed to the application of activating chemicals.

EXAMPLE 6

As described for the Examples 1 through 5, three slivers consisting in this example of polyacrylonitrile fibers of the type Leacryl, marketed by Montedison-Fiber, Via Pola 14, Milano, Italy, the staple length of which was 90 mm and the fiber fineness of which was 2 den were processed into a stabilized fiber sliver. The non-twisted fiber arrangement of an English cottom count of 0.3 or 1900 tex was impregnated using a dye bath liquor containing in one liter of water:

96 g of the cationic dyestuff of the formula:

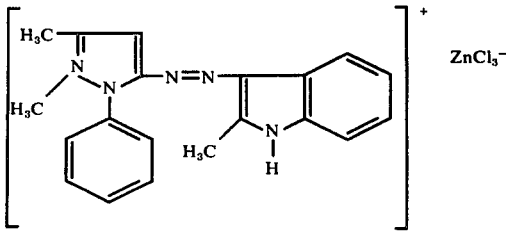

13 g of the cationic dyestuff of the formula:

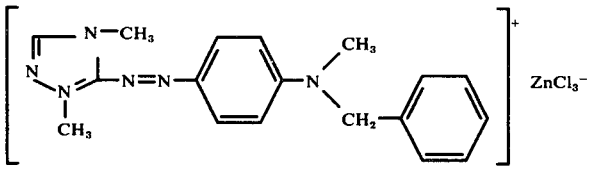

60 g ethylene carbonate, as specified in Example 2 as activating chemical, 12 g Meypro-Gum NP 25, and 6 g Meypro-Gum PAT/S as thickener, as specified in the Examples 2 and 3, and 24 g ethyl alcohol 95 percent, as wetting agent for the dyestuffs.

The dye bath liquor was adjusted to pH4 by adding tartaric acid, and its viscosity was found to be 80 centipoise. As described for Example 3 squeezing was effected to a liquor content remaining in the sliver of 60 percent, and the fiber sliver was compacted, activated, and dryed, and a scarlet stabilized fiber sliver was obtained.

The fixation of the dyestuff again was effected at an activating temperature of 160° C. The degree of dyestuff fixation after a duration of exposure to fixation conditions of 90 seconds at a fiber sliver throughput speed of 200 meters per minute was found to be 98 percent. The breaking length of the resulting stabilized fiber sliver was found to be about 1300 meters.

The stabilized fiber sliver with this breaking length and of an English cottom count 0.3 or 1.900 tex was draftable on a drafting arrangement of a ring spinning machine at a draft ratio of 100 and was transformed into a yarn of English cotton count 30 or 20 tex. Owing to the low thickener contents in the dye bath liquor, slight dust shedding merely was observed during the processing of the fiber sliver on the ring spinning machine.

EXAMPLE 7

A sliver consisting of polyacrylonitrile fibers of the type Dralon marketed by Farbenfabriken Bayer AG, mentioned before, of a staple length of 60 mm and of a fiber fineness of 6 den, and of an English cotton count 0.12 or 4900 tex was supplied one end up, without doubling with other slivers, to a drafting arrangement and was drafted at a drafting ratio of 10 thereon into a fiber arrangement of English cottom count 1.2 or 490 tex. As described with reference to Example 5, a stablized fiber sliver was produced using for impregnation of the fiber arrangement a dye bath liquor containing in one liter of water:

a dyestuff mixture, consisting of:

48 g of the dyestuff of the formula:

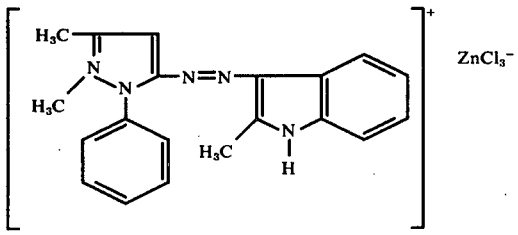

14 g of the dyestuff of the formula:

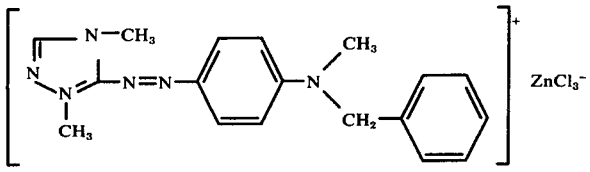

and 5 g of the dyestuff of the formula:

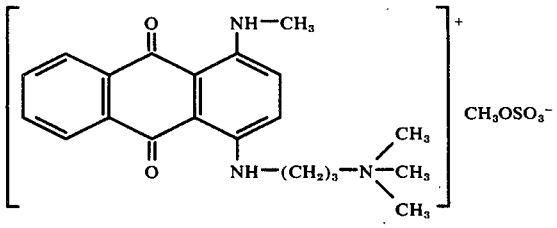

90 g of the tetramethylene sulfone Bondolane A, as specified in Example 4, and 40 g ethyl alcohol 95 percent as a wetting agent for the dyestuffs.

The dye bath liquor again was adjusted to pH4 by adding tartaric acid. As described with reference to Example 5 squeezing was effected to a liquor content remaining in the fiber sliver of 51 percent, and at the same time the fiber sliver was compacted, activated and dryed and a red-brown stabilized fiber sliver was obtained.

Fixation of the dyestuff of the fiber was effected simultaneously at the activating temperature. The degree of dyestuff fixation was found to be 97 percent, after a duration of fixation of 75 seconds while the compact fibre sliver was passing through the treatment device at a speed of 200 meters per minute. The breaking length in this stabilized fibre sliver was found to be approx. 8000 meters, at which breaking length the sliver could not be drafted on a drafting arrangement without destruction of the fibres. A fibre sliver of this type, of an English cotton count 1.5 in advantageous manner can be used as an already dyed carpet yarn, i.e. can be processed further. The dye bath liquor free of thickeners in this Example proved particularly advantageous as no dust shedding by the stabilized fibre sliver was observed during the immediately subsequent further processing on a weaving machine.

EXAMPLE 8

A liquor is prepared as follows:

a. 1 part of the dyestuff of the formula

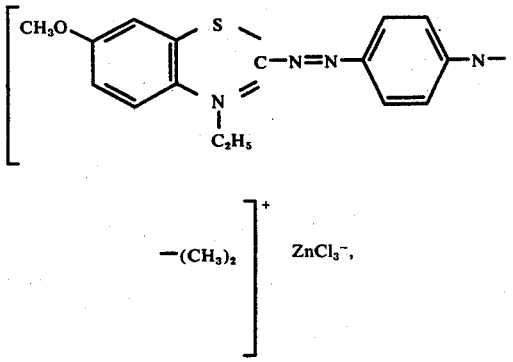

b. 5 parts of a locust bean flour preparation and
c. 3 parts of benzylpropoxynitrile in emulsified form.

The pH-value is adjusted to between 4 and 5 by addition of acetic acid, and the liquor is made up with water to 100 parts. This liquor is used to impregnate a polyacrylonitrile arrangement at 20° to 30°, with 100% of liquor, relative to the weight of the fibre, being absorbed.

The impregnated sliver is subsequently continuously steamed for 30 minutes with saturated steam at 100°.

The result is a stabilized bonded sliver in a pure blue shade having good fastness properties.

EXAMPLE 9

A liquor is prepared as follows:
a. 1 part of the dyestuff of the formula

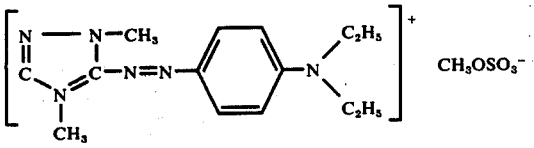

b. 5 parts of polyvinyl acetate emulsion, and c. 5 parts of tetramethylenesulphone.

The pH-value is adjusted to between 4 and 5 by the addition of citric acid, and the liquor is made up to 100 parts with water.

This liquor is used to impregnate at 20° to 30° a tow made from polyacrylonitrile, with 100% of liquor, relative to the weight of the material, being absorbed.

The impregnated material is subsequently continuously treated under tension for 6 minutes at 120° with steam having a water content of over 90%.

There is obtained a stabilized bonded sliver of filaments, dyed in a deep shade of red, well dyed throughout and having very good fastness properties.

EXAMPLE 10

A liquor is prepared as follows:
a. 1.5 parts of the dyestuff of the formula

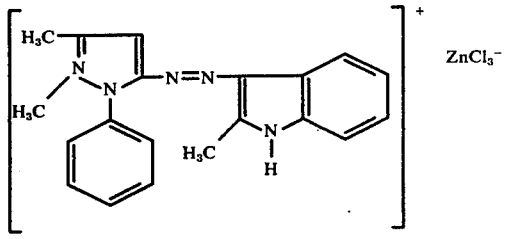

0.6 part of the dyestuff of the formula

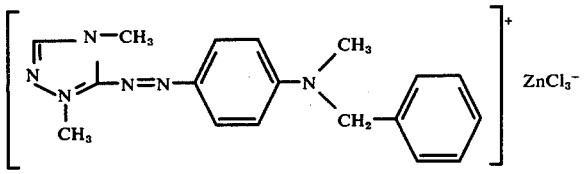

and 0.65 part of the dyestuff of the formula

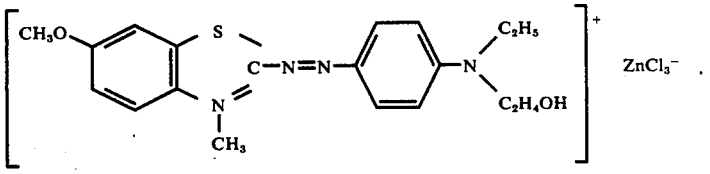

b. 5 parts of acrylic acid ester and
c. 4 parts of propylene carbonate.

A pH-value of between 4 and 5 is obtained by the addition of tartaric acid, and the liquor is made up to 100 parts with water. An arrangement of polyacrylonitrile staple fibres is continuously impregnated at a temperature between 20° to 30° C with the said liquor, so that 50% of liquor, relative to the weight of the fibre, is absorbed.

The impregnated sliver is then continuously treated in the course of 4 minutes at 140° with steam having a water content of over 90%.

The result is a stabilized bonded sliver in a brown shade which is very well fixed and has good fastness properties.

EXAMPLE 11

A liquor is prepared as follows:
a. 2 parts of the dyestuff of the formula

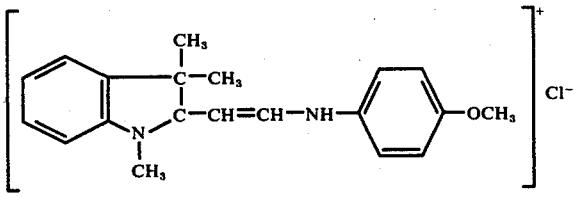

1 part of the dyestuff of the formula

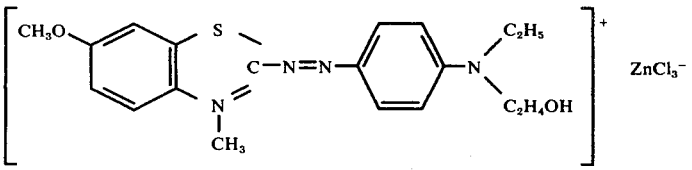

b. 2 parts of carboxymethylcellulose,
c. 6 parts of tetramethylenesulfone and
d. 2 parts of 2-phenoxyethanol.

A pH-value of between 4 and 5 is obtained by the addition of tartaric acid, and the liquor is made up to 100 parts with water. A polyactylonitrile staple fibre arrangement is continuously impregnated at a temperature of between 20° to 30° C with the said liquor, so that 50% of liquor, relative to the weight of the fibres, is absorbed. The impregnated sliver is then continuously treated for 3 minutes at 160° with steam having a water content of over 70%.

There is obtained a stabilized bonded sliver in green, which is very well dyed throughout and has good fastness properties.

If, instead of a polyacrylonitrile fibre arrangement, there is used a fiber arrangement made from acid modified polyester, with the procedure otherwise remaining the same, then an equally stabilized bonded sliver is obtained.

The concentration of the latent chemical applied in the dye bath liquor is not limited to the concentrations indicated in the Examples described above. Depending on the components and parameters of the implementation of the inventive method, and depending also on the desired end use of the fibre sliver or strand produced according to the inventive method, the latent chemical also can be applied in concentrations ranging from 10 to 100 g per liter, preferably ranging from 40 to 60 g per liter of dye bath liquor.

Having now described in considerable detail illustrative and preferred embodiments of the invention, it should be apparent that the objects set forth at the outset of this specification have been satisfied, and further, it is to be distinctly understood that the invention is not limited thereto but may be otherwise variously embodied and practiced within the scope of the following claims. Accordingly,

What is claimed is:

1. A method of producing a dyed and stabilized fibre sliver comprising the steps of:

a. impregnating a throughpassing non-twisted fibre arrangement composed of individual fibres with a liquid, said liquid including an effective amount of a chemical compound for mutually bonding the fibres of said fibre arrangement and a dyestuff for dyeing said fibres;
b. squeezing-off excess liquid from the fibre arrangement by application of pressure thereto and condensing the fibres at all sides into a compact non-twisted fibre sliver by said application of pressure;
c. subjecting the compact fibre sliver to elevated temperature;
d. said fibre arrangement being impregnated with said chemical compound which has latent activity upon the material of the fibres at a temperature lower than said elevated temperature and which activates the fibre material at said elevated temperature;
e. simultaneously dyeing and mutually bonding the individual fibres by the fibre material activated by said chemical compound at said elevated temperature;
f. removing said activating chemical compound from said compact sliver; and
g. drying said non-twisted sliver.

2. The method according to claim 1, including the step of impregnating the fibre arrangement with an undiluted liquid activating chemical compound containing the dyestuff distributed therein.

3. The method according to claim 1, including the step of impregnating the fibre arrangement with the activating chemical compound distributed in a liquid.

4. The method according to claim 3, including the step of impregnating the fibre arrangement with the activating chemical compound solved in the liquid.

5. The method according to claim 3, wherein the fibre arrangement is impregnated with an aqueous solution of the activating chemical compound.

6. The method according to claim 5, wherein the fibre arrangement is impregnated with the aqueous solution which contains 10 to 100 grams per liter of the activating chemical compound.

7. The method according to claim 6, wherein the fibre arrangement is impregnated with the aqueous solution which contains 40 to 60 grams per liter of the activating chemical compound.

8. The method according to claim 5, wherein a fibre arrangement of polyacrylonitrile fibres is impregnated with an aqueous solution of a tetramethylene sulfone serving as said activating chemical compound.

9. The method according to claim 8, including the step of impregnating the fibre arrangement with an aqueous solution of a tetramethylene sulfone which contains a cationic dyestuff.

10. The method according to claim 8, including the step of drying the fibre sliver at the activating temperature while the activating chemical compound and the solvent are evaporated.

11. The method according to claim 5, wherein a fibre arrangement of polyacrylonitrile fibres is impregnated with an aqueous solution of a member selected from ethylene carbonate or propylene carbonate serving as said activating chemical compound.

12. The method according to claim 11, including the step of impregnating the fibre arrangement with said aqueous solution which further contains a cationic dyestuff.

13. The method according to claim 11, including the step of drying the fibre sliver at the activating temperature while the activating chemical compound and the solvent are evaporated.

14. The method according to claim 1, wherein the dyestuff is directly fixed on the individual fibres which contact one another and the individual fibres at their contacting points are directly mutually bonded by the fibre material.

15. The method according to claim 1, including the steps of evaporating the activating chemical compound at the elevated activating temperature, and activating the fibre material during the time during which such evaporation is effected.

16. The method according to claim 15, further including the step of totally evaporating the activating chemical at the elevated activating temperature.

17. The method according to claim 1, including the step of drying the fibre arrangement at the elevated activating temperature.

18. The method according to claim 1, including the steps of exposing the compact fibre sliver over a period of time to the elevated activating temperature, subsequently bringing said fibre sliver to a lower temperature, washing out the activating chemical compound at the lower temperature, and subsequently drying the fibre sliver.

19. The method according to claim 1, including the step of adding a thickener to the liquid for increasing the viscosity thereof.

20. The method according to claim 1, including the step of adding at least one further textile finishing agent to the liquid.

21. The method according to claim 1, including the step activating the fibre material at a temperature greater than 100° C.

22. The method according to claim 1, including the steps of impregnating a fibre arrangement of polyacrylonitrile fibres and activating said fibres at a temperature between 160° and 180° C.

23. The method according to claim 1, including the step of effecting fixation of the dyestuff on the fibres by heat treatment of the fibre sliver.

24. The method according to claim 1, including the step of fixing the dyestuff at the elevated activating temperature.

25. The method according to claim 1, including the steps of squeezing-out excessive liquid and condensing the fibres into the compact sliver by application of a specific surface compression of 200 kg per square centimeter.

26. The method according to claim 1, including the step of squeezing-off excessive liquid to a remaining liquid content of 20 to 80 percent in the fibre arrangement.

27. The method according to claim 1, including the step of stabilizing the fibre sliver lengthwise by condensing the fibres from all sides and by mutually bonding the fibres.

28. The method according to claim 1, including the step of stabilizing the fibre sliver transversely by condensing the fibres from all sides and by mutually bonding the fibres.

29. The method according to claim 1, including the step of drafting the fibre arrangement immediately before it is impregnated.

30. The method according to claim 1, including the step of impregnating a fibre arrangement consisting of doubled and drafted slivers of staple fibres.

31. The method according to claim 1, wherein the steps of impregnating, condensing, dyeing and activating are carried out while the fibre arrangement and the fibre sliver are passing through at speeds ranging from 100 to 200 meters per minute.

32. The method according to claim 1, including the step of exposing the compact sliver to the activating temperature during a time period ranging from 30 to 90 seconds.

33. A stabilized and dyed non-twisted fibre sliver produced according to the method according to claim 1, containing individual fibres which are dyed and are mutually bonded by the fibre material.

34. The fibre sliver according to claim 33, wherein the individual fibres are directly mutually bonded by the fibre material.

35. The fibre sliver according to claim 33, containing staple fibres which are substantially parallel to one another.

36. The fibre sliver according to claim 31, which has a stability suitable for drafting on a drafting arrangement.

37. The fibre sliver according to claim 33, the stability of which is suitable for immediate subsequent further processing into a textile end product.

38. The fibre sliver according to claim 33, which is stabilized lengthwise.

39. The fibre sliver according to claim 33, which is stabilized in its lengthwise and transverse direction.

40. A stabilized and dyed non-twisted fibre sliver containing individual fibres which are dyed and are mutually bonded by the fibre material.

* * * * *

UNITED STATES PATENT AND TRADEMARK OFFICE

CERTIFICATE OF CORRECTION

PATENT NO. : 4,025,302

DATED : May 24, 1977

INVENTOR(S) : Werner NAEGELI and Antonius SCHNEIDER

It is certified that error appears in the above-identified patent and that said Letters Patent are hereby corrected as shown below:

Column 2, line 60, after "non-twisted" insert --fibre arrangement.--.

Column 2, line 61, before "According to the British" delete "According arrangement.".

Column 18, lines 60 to 65, delete the formula appearing at Example 11, and insert in place thereof the following formula.

UNITED STATES PATENT AND TRADEMARK OFFICE

CERTIFICATE OF CORRECTION

PATENT NO. : 4,025,302

DATED : May 24, 1977

INVENTOR(S) : Werner NAEGELI and Antonius SCHNEIDER

It is certified that error appears in the above-identified patent and that said Letters Patent are hereby corrected as shown below:

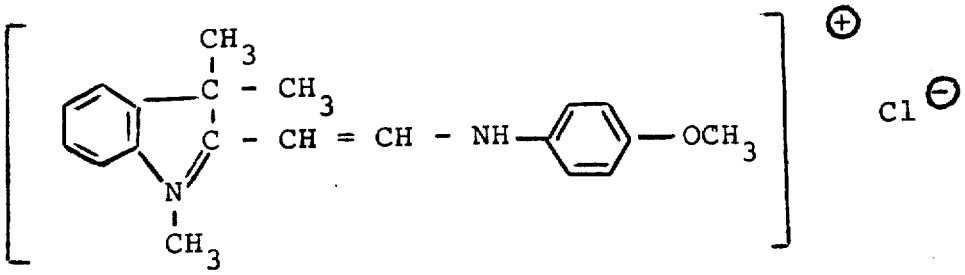

(The formula appearing at Example 11 should have a double bond at the nitrogen atom of the 5th ring.)

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*